US005884932A

United States Patent [19]

Ignatius

[11] Patent Number: 5,884,932

[45] Date of Patent: Mar. 23, 1999

[54] SLIDING BODY, IN PARTICULAR A SKI OR RUNNER

[76] Inventor: Georg Ignatius, Paradiesbuck 12, D-79429 Malsburg, Germany

[21] Appl. No.: 537,724

[22] PCT Filed: Feb. 14, 1995

[86] PCT No.: PCT/EP95/00540

§ 371 Date: Apr. 1, 1996

§ 102(e) Date: Apr. 1, 1996

[87] PCT Pub. No.: WO95/21663

PCT Pub. Date: Aug. 17, 1995

[30] Foreign Application Priority Data

Feb. 14, 1994 [DE] Germany ..... 44 04 475.5

[51] Int. Cl.[6] ..... A63C 5/07

[52] U.S. Cl. ..... 280/602; 280/610

[58] Field of Search ..... 280/601, 602, 280/609, 610

[56] References Cited

U.S. PATENT DOCUMENTS 4,679,814 7/1987 Meatto et al. ..... 280/610

5,585,579 12/1996 Ignatius .

FOREIGN PATENT DOCUMENTS 9316962 1/1994 Germany .

WO851220 3/1985 WIPO .

*Primary Examiner*—Richard M. Camby

*Attorney, Agent, or Firm*—Tarolli, Sundheim, Covell, Tummino & Szabo

[57] ABSTRACT

A sliding device, in particular a ski, comprises a sliding body and means on the sliding body for controlling vibration thereof. The controlling means comprises at least one sequence of a plurality of spatial, planar or linear areas, each of which is distinguished from at least a part of its vicinity by at least one differently dimensioned or distributed vibration parameter. The center distances between subsequent distinguished areas, or the distances between certain sections within subsequent distinguished areas, is dimensioned according to at least one predetermined increasingly or decreasingly varying progression. The increasingly or decreasingly varying distances are configured such that the areas establish a vibration active structure of the sliding body with a plurality of natural or resonant frequencies.

22 Claims, 6 Drawing Sheets

SLIDING BODY, IN PARTICULAR A SKI OR RUNNER

RELATED APPLICATIONS

This application is based under 35 USC 371 on, and claims the benefit of PCT/EP95/00540, filed Feb. 14, 1995, published as WO95/21663 Aug. 17, 1995.

BACKGROUND OF THE INVENTION

1. Technical Field

The invention relates to a sliding body, in particular a ski or runner, as they are usable with apparatus and vehicles, particularly for snow and ice, but for water sports also.

2. Description of the Related Art

Essential for good sliding properties as well as for directional stability and steering ease or manoeuvrability resp. and also for durability under shock-like and vibrating stresses is the oscillating response of the body or its external parts getting in interaction with the sliding medium. According to usual technique substantially only he oscillating response in very low frequency ranges is taken into consideration. In this way spacious or macroscopic phenomina can be taken into account which, however, left open desires for various optimizations up to now.

Therefore, the task of the invention is the creation of sliding bodies further improved with regard to the aforesaid points. The basic idea of the solution according to the invention here is taking into account medium and higher frequency ranges or characteristic frequencies and above all, the resonance spectra in those ranges.

To the the task as set above the solution according to the invention is defined by the features of the patent claim 1 or of the subordinate claims. The features of the dependent claims present inventively essential integral parts or further developments resp.. The subject matters thereof are practicable each alone, however, with special advantages in the various possible combinations.

The basic idea of the invention consists in the realization of at least one vibration-reactive subdivisional structure with at least one sequence of distinct spatial, superficial or linear region, which present at least one vibration parameter, particularly a local spatial or suberficial mass density, resistance to bending deformation or dampening, which is dimensioned or distributed differently in relation to at least one adjacent region or within the region itself. With advantage there is provided at least one sequence of a plurality of distinct regions with differently dimensioned or distributed vibration parameters. Further an essential feature consists in providing at least one periodic sequence of distinct regions with differently dimensioned or distributed vibration parameters. In particular at least one sequence of distinct regions with differently dimensioned or distributed vibration parameters is considered, which sequence extends along a surface of the sliding body, and which e.g. may comprise at least one sequence of distinct regions extending substantially in the interior of the sliding body and having differently dimensioned or distributed vibration parameters, particularly at least one sequence of distinct regions having differently dimensioned or distributed vibration parameters and extending multidimensionally or in a plurality of spatial or superficial directions.

In further developing the invention at least partially different distance sequences between the distinct regions and/or different vibration parameter variations from region to region are assigned to the different dimensions or spatial or superficial directions resp., in which a sequence of distinct regions with differently dimensioned or distributed vibration parameters extends, in which context particularly said distinct regions with differently dimensioned or distributed vibration parameters are arranged serially or grid-like in at least one area, particularly within a surface section of the sliding body.

The distinct regions of different vibration parameters may be arranged in a distribution in at least one surface section and/or at least one wall section of a cavity of the sliding body or along at least one edge of the sliding body. In a further variation the distinct spatial, superficial or linear regions comprise at least one section with values of one or more vibration parameters being higher in relation to its vicinity.

In a further variation of the invention there are sections provided having vibration parameters, particularly a surface-related local mass density or a local deformation resistance, which is higher in relation to at least a part of their vicinity due to elevations within a surface of the sliding body, said elevations being formed particularly rib-, wave- or hump-like and preferably formed as mounted elements in the range of a sliding body surface. A preferred realization provides sections having vibration parameters, in particular a surface-related local mass density or a local deformation resistance, which is higher in relation to at least a part of their vicinity, said sections being formed by elements embedded in a basic material. Such embedded elements e.g. may consist of at least one material different from the basic material, in particular of a material of higher density or of a higher elasticity modulus, preferably of heavy metal.

An important further development provides spatial or superficial regions having at least one section with values of one or more vibration parameters, particularly a surface-related local mass density or a local deformation resistance, being minor in relation to their vicinity. Such sections e.g. are formed as excavations or openings within a surface of the sliding body, particularly also as depressions in the form of notches or callote shells. Essential is also the possibility to realize the sections with values of at least one vibration parameter minor in relation to their vicinity, in particular of surface-related local mass density or local deformation resistance, by means elements embedded in a basic material. Such embedded elements may consist of at least one material different from the basic material, particularly of a material of lower density or of a lower elasticity modulus, preferably of light metal.

An inventive idea leading further is characterized by at least one vibration-reactively subdivided surface layer or at least one layer section, particularly in the form of a coating by granulates, lacquer or foil, preferably with metal contents.

Further essential according to the invention is a realization in which at least in a part of a vibration-reactive subdivision the center distances of subsequent distinct spatial, superficial or linear regions or the distances between certain sections within subsequent distinct regions are dimensioned at least approximately equal. There it is often sufficient and advantageously simple that at least in a part of of a vibration-reactive subdivision the extremal or average values or the distribution of the values of at least one vibration parameter in subsequent distinct regions are dimensioned at least approximately equal. However, for optimazation it is generally advisable, at least in a part of a vibration-reactive subdivision, to dimension the center distances of subsequent distinct regions or the distances between certain sections within subsequent distinct regions variable with regard to a predetermined sequential direction.

With certain effects which are advantageous depending on the application conditions, there the center distances of subsequent distinct regions or the distances between certain sections within subsequent distinct regions may be dimensioned progressively or degressively variable in a sequential direction in at least a part of a vibration-reactive subdivision. Here again it may be essential to dimension the extremal or average values or the distribution of the values of at least one vibration parameter in subsequent distinct regions variable with regard to a predetermined sequential direction, that is with specific effects with regard to a predetermined sequential direction progressively or degressively variable, particularly e.g. in the form of a sequence of distances or values being unidirectional at least by sections. In particular a sequence of distances or values oscillatingly variable at least by sections is considered. In this context a particularly essential variation consists in that the distinct regions subdivide a total or partial dimension of the sliding body in accordance with the values of a predetermined progression.

Thorough investigations and practical experiments have shown that the sequence of distances and/or subdivisions and/or values should be dimensioned at least approximately according to a harmonic progression, in special cases eventually according to a geometric progression.

A rapid further development of the inventive ideas consists in providing at least one vibration-reactive subdivision which comprises at least one superpositional structure extending linearly, superficially or spatially and containing at least two sequences of distances and/or subdivisions and/or values. There a specific mode of realizing this feature may comprise at least one vibration-reactive subdivision with at least one superpositional structure extending linearly, superficially or spatially and containing at least two equidistant sequences.

The values and/or distribution of at least one vibration parameter in the subsequent distinct regions e.g. may be dimensioned at least approximately equal within each equidistant sequence, however, preferably these values are dimensioned at least by sections in accordance with at least one harmonic or at least one geometric progression or in accordance with a superposition of such progressions.

The features according to the invention have been investigated and optimized particularly thoroughly with skis and runners resp.. Therein it has proved essential that at least one vibration-reactive subdivision is realized which has at least one sequence of distinct spatial and/or superficial and/or linear regions extending in the longitudinal or running direction of the ski or runner body and having at least one vibration parameter each, which is dimensioned or distributed differently in relation to an adjacent region.

As to the common basis of the variations according to the invention the following hint is given: Vibration-reactive in the sense of the invention is a subdivision having distinct or in relation to their vicinity different and subsequently, particularly in mutual coupling arranged regions, which with regard to their own vibration parameters or with regard to vibration parameters defined by coupling with their vicinity are in the range of characteristic frequencies or of the characteristic frequency spectrum of a body given as the initial object or of a body to be realized with certain properties. A quantitative delimitation of the vibration reactivity, therefore, must comply with conditions of the relevant application. Such delimitation can be obtained theoretically or by calculation or by experiment on the basis of well-known criteria, often even directly evident. Accordingly, the effect of such a vibration-reactive subdivision is directed to a desired design of the characteristic frequency spectrum. The target may be e.g. densifying the characteristic frequencies, i.e. increasing the number of characteristic frequencies in a given frequency range, or the creation of new characteristic frequencies as well as an equalization, enhancement or lowering of the curve of the resonance amplitudes in a frequency range or a plurality thereof. All this can be used for a well-defined influence on sliding bodies with regard to their sliding and running properties and/or their steering ease or manoeuvrability, but also with regard to their durability under dynamic stresses.

In many cases, particularly e.g. for skis and runners, principally, however, also for carrier and buoyant bodies moved in media such as boat bodies and the like decreasing the surface friction is desired. Enhancement or new creation of relatively high characteristic frequencies in the surface range of of the body can serve for this.

On the other side, in operation sliding bodies are under continual, but uneven i.e. mostly non-periodical stress with more or less shock-like pressure forces and/or bending and/or torsion moments. A correspondingly uneven succession of short-time free (not constrained periodical) vibrations with the characteristic frequencies of the body is excited thereby. The corresponding elastic deformations mostly have undesired effects, above all in lower frequency ranges, but in these frequency ranges they are relatively difficult to be dampened. Dislocation of characteristic frequencies to higher frequency ranges or enhancement of the resonance amplitudes in these ranges by means of suitably designed vibration-reactive subdivisions can be a help here, and this often with relatively low structural expenses. In particular it has to be stated that the excitation energy from the successive shock-like stresses are absorbed in a certain distribution over the characteristic frequencies of the body. Accordingly, a relatively great number of characteristic frequencies or an increased density of characteristic frequencies as it is obtainable by applying the ideas of the invention, can be used for a general decrease of the occuring maximal vibration or deformation amplitudes, preferably in combination with a dislocation of the vibration energy into less disturbing frequency ranges.

DESCRIPTION OF THE PREFERRED EMBODIMENTS

Figure 1:
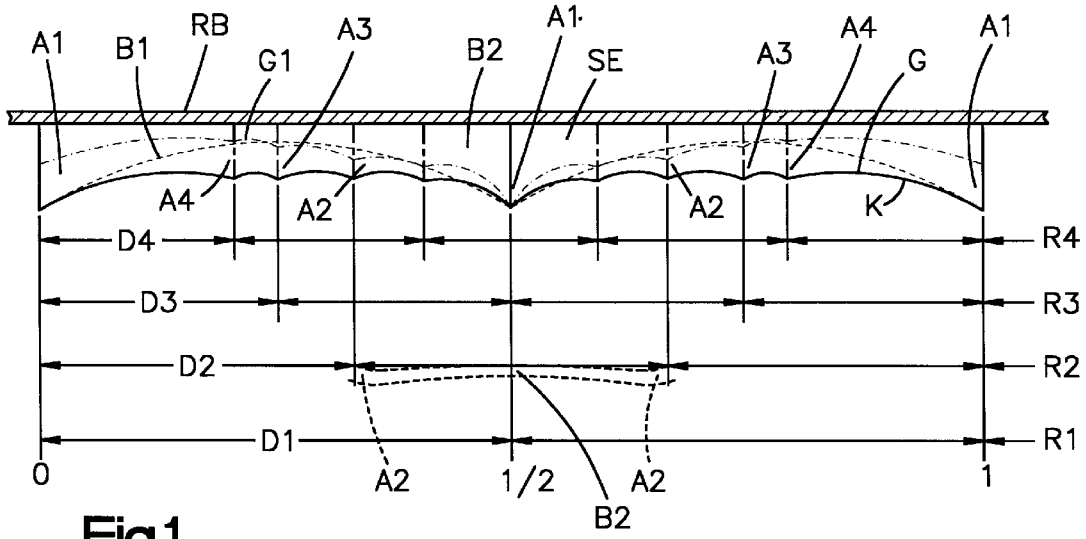
FIG. 1 is a schematic view of a stiffening rib which is profiled in a manner in accordance with a first embodiment of the present invention.

The invention will be further explained with reference to the examples of embodiments schematically shown in the drawings.

In FIG. 1 there is shown a stiffening rib in the form of a longitudinal extending vibration element SE connected in a shear-resistant manner with wall RB of a sliding body. Besides its static bearing function in reinforcing the sliding body this element being part of the body as a whole has substantial influence on the resonance spectrum and the vibrating transition behavior. Specifically here provision is made for a subdivision G of the longitudinal Profile, the subdivision being distributed in a non-uniform manner along the beam length and consisting of an as to the profile height additive superposition of four equidistant sequences R1 to R4. Each such sequence comprises regions A1, A2, A3 and A4 of enhanced bending-deformation rigidity as well as regions B1, B2 ect. arranged alternatively with the latter ones and being of reduced bending-deformation rigidity. In the stiffened regions there is also an enhanced vibration mass packing, as far as not by additional measures—such as a reduction of the profile width or a reduction of the cross-sectional surface in the middle region of the cross-sectional height, e.g. in the form of excavations or holes—a compensation or even an overcompensation of such mass enhancement is accomplished.

The vibration pattern of a resonant body in general consists of manifold superpositions of standing waves of different wavelength and amplitude. In the node ranges there prevails a small or vanishing elastic bending deformation, in the antinode ranges a maximal elastic bending deformation. In the ranges of enhanced or reduced bending rigidity consequently the formation of vibration nodes or antinodes resp. is favoured. Now, whitest a simple equidistant distribution of regions of enhanced and reduced rigidity favours the formation of a standing wave merely concentrated in the range of one resonance frequency, which in fact makes available certain desired enhancements within the resonance spectrum, the superposition of different equidistant sequences of regions of enhanced and reduced rigidity renders possible the enhancement of a corresponding frequency band.

By choosing the distance values D1, D2 etc. (compare FIG. 1) of the mutually superimposed sequences and by choosing the ratio values thereof the ranges of the resonance spectrum, in which the enhancements appear, can be adjusted in a desired and reproducible manner to a great extent. In the interest of a well-balanced spectral curve and of a desired adjustment of continuous transitions therein the rigidity differences within the sequences may be dimensioned differently, advantageously in such manner that these differences are stepped from sequence to sequence in a sense equal to the distance values. Such an embodiment has been indicated in FIG. 1 by the profile contour represented by a continuous line. The partial contours of sequences R1 and R2 have been shown by dash lines. On the other side, in the interest of especially soft transitions the rigidity differences may be varied within one and the same sequence also, such as in a manner so as to decrease towards both sides starting from the central point of the vibration element or of a section thereof. E.g. this leads to subdivision G1 as shown in FIG. 1 by dash-dot lines.

Figure 2:
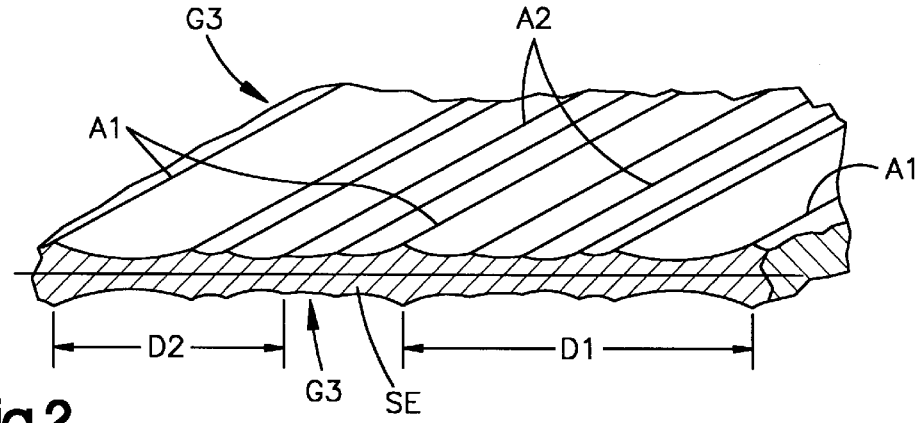
FIG. 2 is a schematic view of a plate-shaped vibration element which is profiled in a manner in accordance with a second embodiment of the present invention.

FIG. 2 shows a plate-shaped vibration element SE2 with a superpositional subdivision G3 at both surfaces. These subdivisions in their cross-sectional profile are in accordance withthe superpositional edge-subdivision G of FIG. 1 as already explained. The regions of enhanced or reduced bending rigidity resp. are forming here a system of juxtaposed, longitudinally extending ridges or grooves resp., which transversely to their longitudinal direction are forming superpositional subdivisions of the kind explained already.

Figure 3:
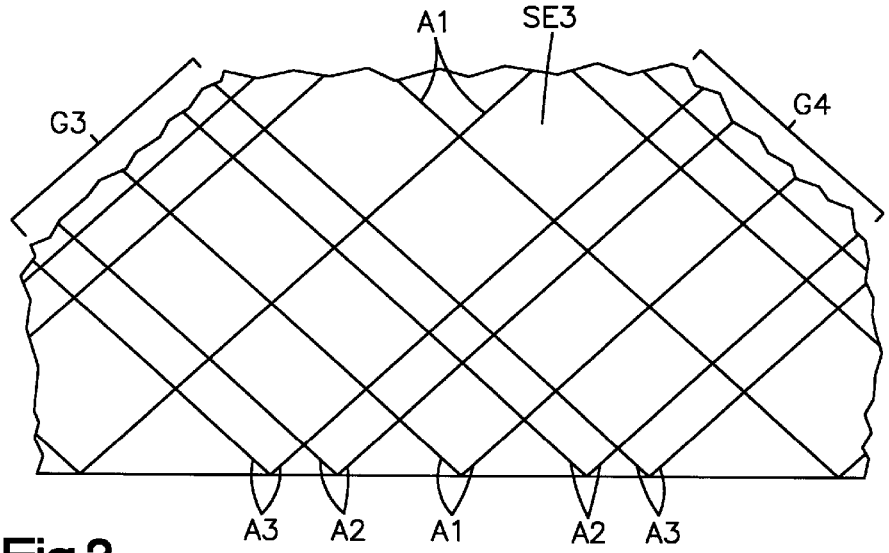
FIG. 3 is a schematic view of an element which is profiled in a manner in accordance with a third embodiment of the present invention.

FIG. 3 represents in a schematical manner the possibility of further refining a superpositional surface-subdivision, i.e. in the form of two systems of ridge-shaped regions A1, A2, A3 of enhanced bending rigidity, these systems crossing each other on one surface of a plate-shaped vibration element SE3 and forming two superpositional subdivisions G3 and G4 in the kind of FIG. 2. Between the ridge-shaped regions there are formed groove-shaped surface regions of reduced bending rigidity, not being provided with reference symbols for the sake of clearness. Subdivisions of this kind are allowing for a well-defined influence on two-dimensional standing wave patterns and should be taken into consideration for enhanced efficiency particularly with more ample resonant assemblies. In cases where portions of plate-resonators with an extraordinarily diminished remaining cross-sectional thickness are to be avoided, a crossing arrangement of a ridge-groove subdivision on each of both plate surfaces is recommended.

Similar subdivisional effects in principal can be obtained with the aid of a non-uniform mass distribution also, in particular with plate-resonators. Presuming a uniform distribution of the deformation rigidity, the preferred locations of wave nodes and antinodes are interchanged, i.e. in regions of increased vibration mass preferably wave antinodes, and in regions of reduced vibration mass wave nodes will appear. Obviously the marginal and fixing conditions of the vibration element section must be compatible with such a wave formation, which is valid correspondingly for rigidity subdivisions also. When regarding these conditions, combined rigidity ans mass subdivisions can be applied with advantage. By the way—as indicated already—non-uniform mass distributions generally will appear also with a non-uniform rigidity distribution. However, in case of rigidity variations by means of accordingly dimensioning the cross-sectional height of a bending vibrator, as generally to be adopted, the effect of mass-enhancement in a region of enhanced cross-sectional height is relatively slight, because the rigidity is effective with a higher power of the cross-sectional height due to its dependence on the cross-sectional moment of inertia. Then in many cases the mass enhancement can be neglected, but in any case it does not disturb generally.

On the other side mass subdivisions without substantial influence on the rigidity can be obtained advantageously also in view of the production, by means of elevations or depressions resp., which are limited on all sides within the vibrating surface, i.e. which are of a dot-like shape. Such elevations or depressions can be formed particularly as holes of small planar dimensions within a plate-shaped vibration element, while for regions of enhanced vibration mass packing the application of additional masses is favourable. In this way particularly rigidity and mass subdivisions can be combined with mutually enhanced efficiency.

Figure 4:
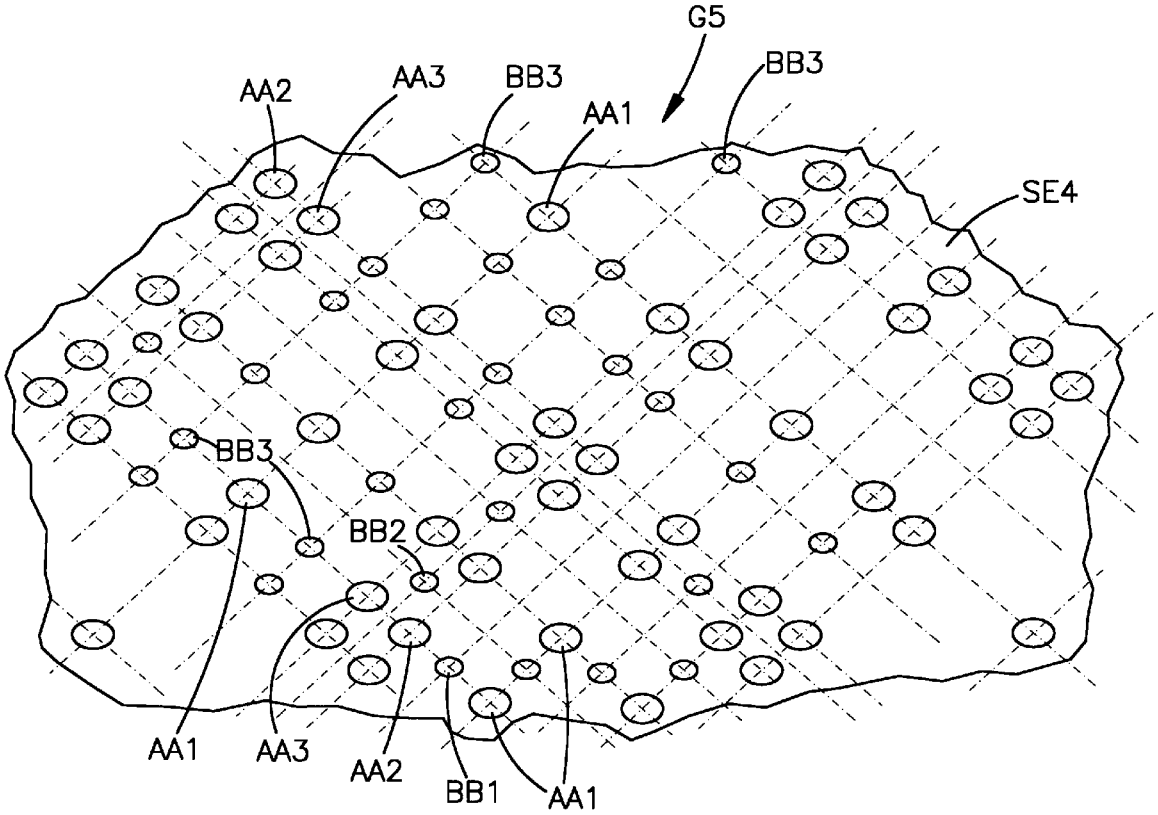
FIG. 4 is a schematic view of a plate-shaped vibration element which is profiled in a manner in accordance with a fourth embodiment of the present invention.

FIG. 4 shows a grid-like mass subdivision G5 extending over the surface of a plate-shaped vibration element SE4 having circular regions AA1, AA2, . . . of enhanced vibration mass and equally shaped regions BB1, BB2, . . . of reduced vibration mass. In its basic structure this grid distribution is in accordance with a two-dimensional along crossimg line systems according to FIG. 3.

Figure 5:
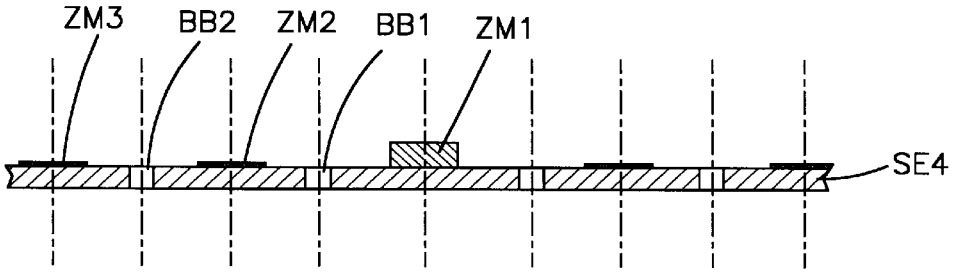
FIG. 5 is a schematic sectional view of the plate-shaped vibration element of FIG. 4.

Thereto FIG. 5 shows the structure of regions BB1, BB2, . . . formed as holes within the thin-walled plate element and the structure of regions of enhanced mass formed as additional mass elements ZM1, ZM2, ZM3, . . . . The latter ones, e.g. in the form of simply shaped, button-like elements can be fixed by glue. In the production there is an especially advantageous possibility of application for elements ZM2 and ZM3 in the form of thin layers consisting of material of high density, as which heavy metals and their alloys, particularly noble metals also, fall into consideration. These elements can be produced cenveniently in the form of foil segments and fixed by glue, but also in the form of formed masses or or lacquer filled with metal. The latter has the special advantage of simplicity as to production technique.

Figure 7:
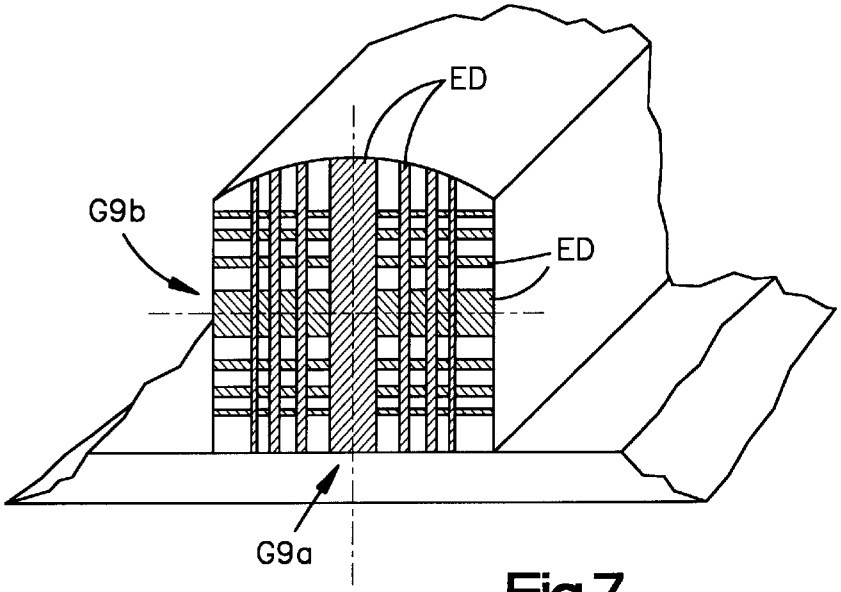
FIG. 7 is a schematic view of a stiffening rib which is profiled in a manner in accordance with a sixth embodiment of the present invention.
Figure 6:
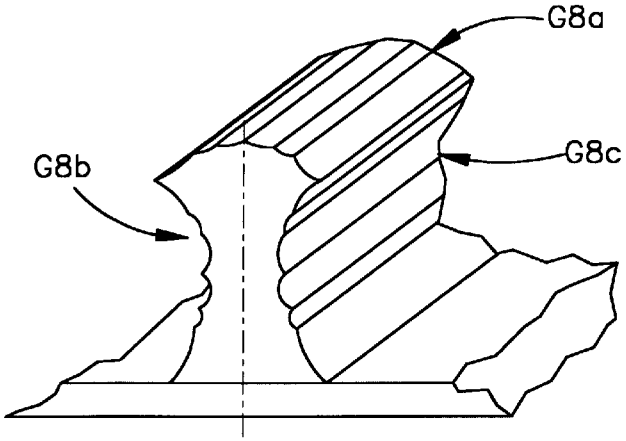
FIG. 6 is a schematic view of a stiffening rib which is profiled in a manner in accordance with a fifth embodiment of the present invention.

The cross-sectional design of a stiffening rib according to FIG. 6 is based on the knowledge that even in relatively compact objects relevant transverse vibrations appear in the solid body, in the present case among others bending vibrations in different directions parallel to the cross-sectional face. Standing waves having their longitudinal direction transverse to the rib's longitudinal direction there are favoured due to the formation of regions of enhanced and reduced bending rigidity, which regions are distributed according to superpositional structures G8a, b, c in accordance with a harmonic progression. Similar effects can be obtained by means of regions or elements ED of enhanced density according to the rib embodiment of FIG. 7 being embedded in the vibrating solid body and arranged in the form of two superpositional subdivisions penetrating each other at right angles.

Figure 8:
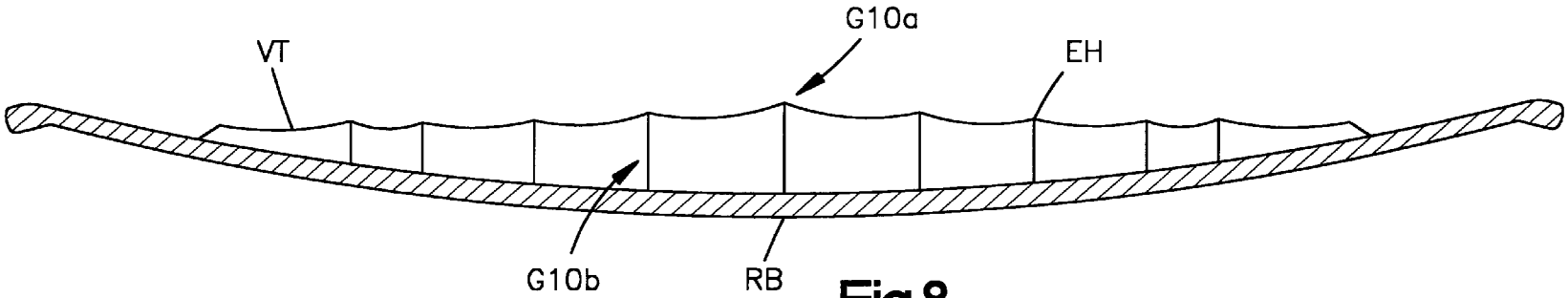
FIG. 8 is a schematic view of a stiffening rib which is profiled in a manner in accordance with a seventh embodiment of the present invention.

FIG. 8 again shows a stiffening rib with subdivision G10a as to its edge and cross-sectional height, but with the cross-sectional height decreasing in the average towards the ends and with globally curved shaping. In addition to the subdivision of said subdivisions G10a at the flanks of the rib provision is made for superpositional subdivisions G10b with wave- and ridge-shaped depressions VT and elevations EH resp. running in the direction of the rib's height, that is with a longitudinal extension set off rectangularly in relation to the subdivision G8a in FIG. 6.

Figure 9:
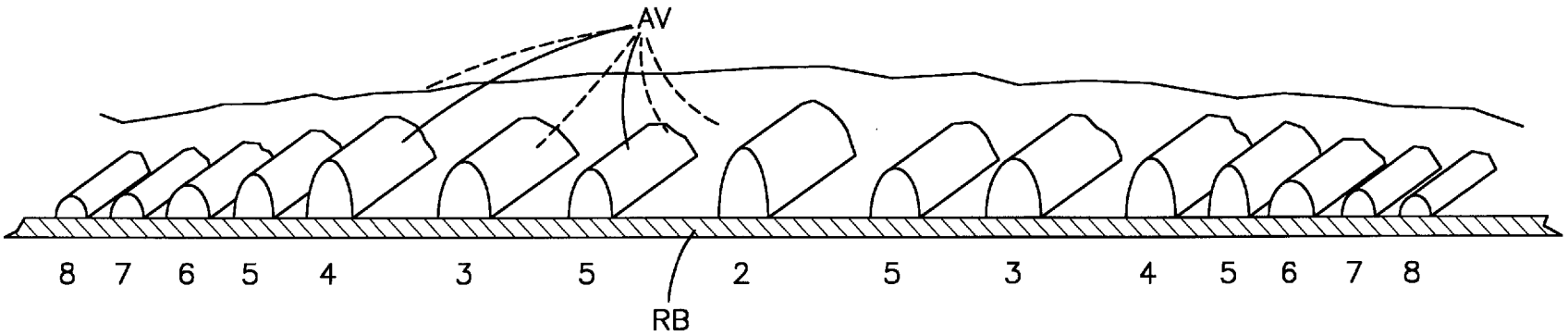
FIG. 9 is a schematic view of a plate-shaped vibration element which is profiled in a manner in accordance with an eighth embodiment of the present invention.

FIG. 9 shows a superpositional subdivision on a plain plate element with rib-shaped mounted stiffening elements AV. Here the subdivision extends merely in a direction transverse to the ribs. The single ribs have been designated merely by the ordinal numbers 1 to 8 of the corresponding harmonics according to the denominator of the distance pitch of the superposition in question. The rib's height and, therewith, the stiffening effect decreases with the ordinal number, which specifically with regard to application conditions may contribute to a well-balanced resonance curve. Such a substantially one-dimensional subdivision favours the formation of standing waves merely in one direction of the plate.

It should be pointed out that by means of the subdivisions according to the invention—depending on the specific design—not only a well-defined tendency towards the formation of standing wave nodes and antinodes resp. can be obtained. Rather similar aspects are valid also for a desired distribution of the vibration dampening. To this end accordingly suitable dampening elements have to be provided in a vibration-reactive subdivision.

Figure 10:
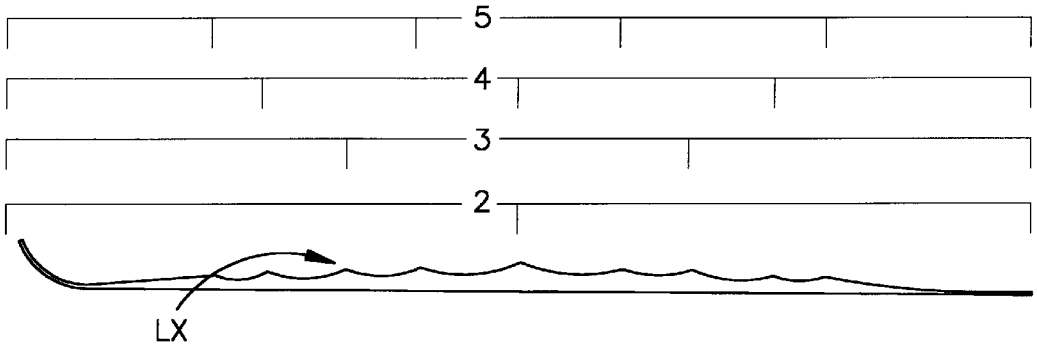
FIG. 10 is a schematic sectional view of a ski which is profiled in a manner in accordance with a ninth embodiment of the present invention.
Figure 11:
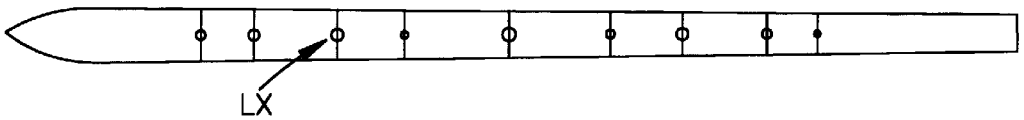
FIG. 11 is a schematic plan view of the ski of FIG. 10.
Figure 14:
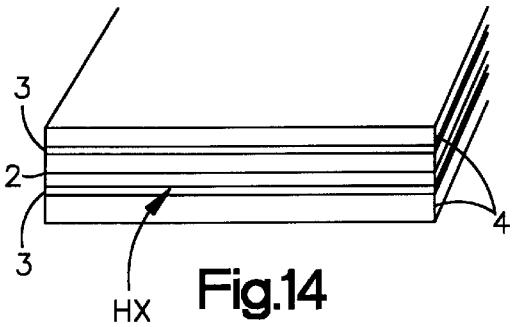
FIG. 14 is a schematic sectional view of a ski which is profiled in a manner in accordance with a twelfth embodiment of the present invention.
Figure 13:
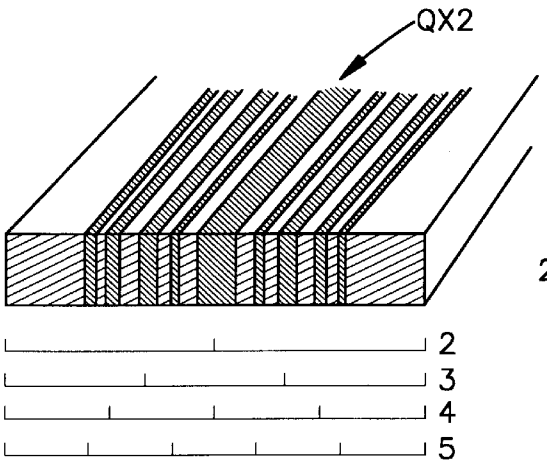
FIG. 13 is a schematic sectional view of a ski which is profiled in a manner in accordance with an eleventh embodiment of the present invention.
Figure 12:
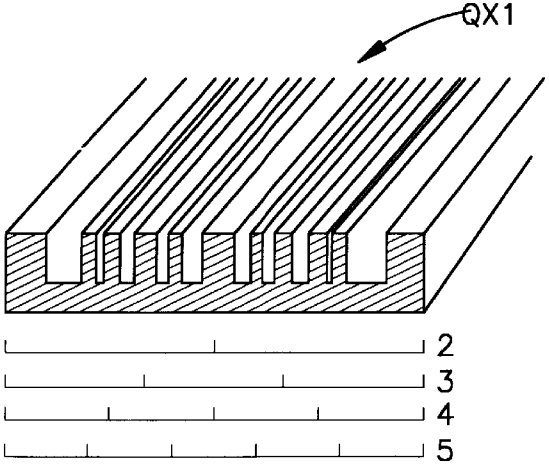
FIG. 12 is a schematic sectional view of a ski which is profiled in a manner in accordance with a tenth embodiment of the present invention.

The FIGS. 10 to 14 are showing as further examples different vibration-reactive subdivisions according to the invention on a ski. FIG. 10 and 11 illustrate schematically a longitudinal subdivision LX with profile elevations and depressions of the kind of the basic embodiments according to FIG. 1. Such an embodiment above all has influence on the bending vibration behaviour of the ski. The embodiments according to the FIGS. 12 and 13 are provided with vibration-reactive subdivisions QX1 and QX2 resp., that is in the form of strip-shaped depressions or excavations extending in the longitudinal direction of the ski at the upper side or in the interior of the ski body's cross-section. If in the form of excavations, obviously provision will be made for a suitable cover, for which vibration-reactive effects are not necessary. FIG. 14 shows, again schematically, a vibration-reactive subdivision HX extending in the direction of the cross-sectional height of the ski and having the form of lamella-like, stiffening and/or mass enhancing insertions in the ski body. Essential for all these variations is the structure of the subdivision, i.e. a multiple superpositional subdivision in the kind of FIG. 1. The equidistances of the single superimposed sequences, measured in portions of the length or the cross-sectional width or height of the ski body, have been indicated by integer numbers. The subdivisions according to the FIGS. 12 to 14 have influence on the behaviour of the ski above all with regard to torsional vibrations. Intensive practical testing, above all in racing-like test runs, has shown that by the subdivisions according to the invention with skis of different basic construction remarkable amendments can be obtained with regard to quiet running even on rough tracks as well as to safe track holding, surprisingly even in combination with amended manoeuvrability. Also worth mentioning is a more intensive sensing contact of the driver with the properties of the ski-run. In particular advantageously sliding bodies of this kind may be provided with subdivisions composed of up to five superimposed sequences of different pitches. Preferably the distances of the sequences will be dimensioned according to harmonic or geometric progressions, again preferably with internally equidistant sequences according to FIG. 1.

Figure 15:
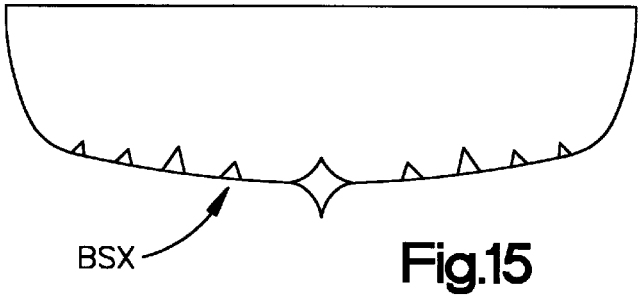
FIG. 15 is a schematic sectional view of a boat body which is profiled in a manner in accordance with a thirteenth embodiment of the present invention.
Figure 16:
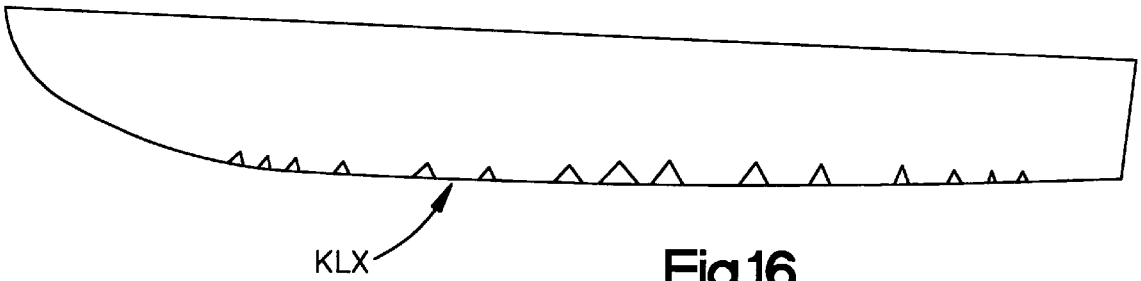
FIG. 16 is a schematic sectional view of a boat body which is profiled in a manner in accordance with a fourteenth embodiment of the present invention.

As examples for numerous applications in the field of media-sliding bodies in the FIGS. 15 and 16 boat bodies have been shown merely schematically in a cross-section and longitudinal section resp., that is with superpositional subdivisions BSX and KLX extending in a port-to-starbord direction and in the direction of the keel resp.. Such vibration-reactive subsubdivisions can be formed e.g. of longitudinal and transverse ribs as distinct regions connected with the inner wall of the body.

Figure 17:
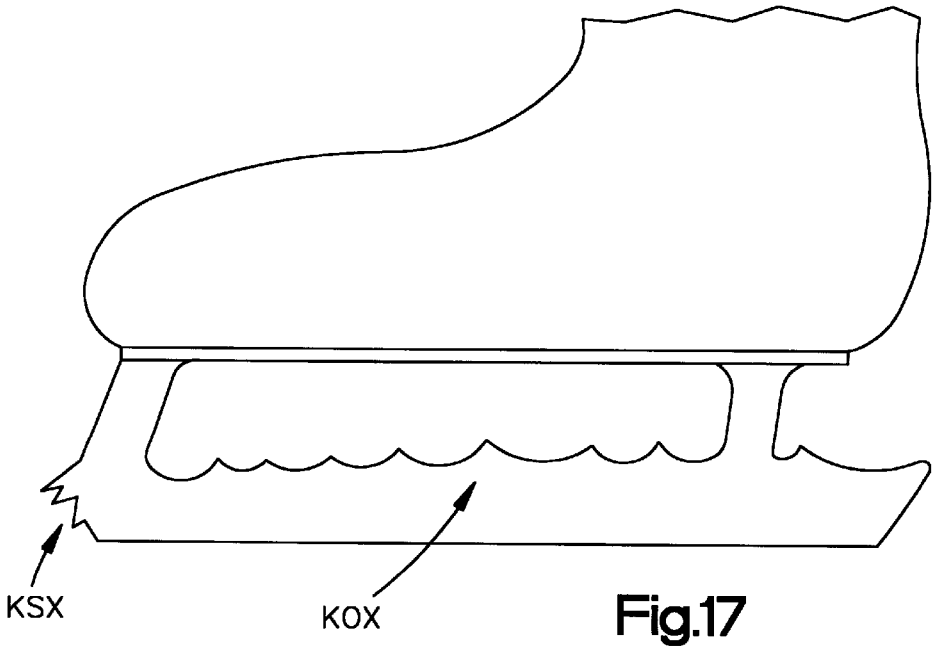
FIG. 17 is a schematic sectional view of a skate which is profiled in a manner in accordance with a fifteenth embodiment of the present invention.

As a last example FIG. 17 shows two two vibration-reactive subdivisions KOX and KSX, again according to the kind of FIG. 1, extending with their elevations and depressions along internal or external edge ranges resp. of a skate runner. Here particularly a reduction of friction can be obtained due to deforming vibrations of the runner body with relatively high frequencies.

What is claimed is:

1. A sliding device, in particular a ski, comprising:

a sliding body, and means on said sliding body for controlling vibration behavior of said sliding body, said means comprising:

at least one sequence of a plurality of spatial, planar or linear areas (A1, A2, A3; B1, B2, B3), each of which is distinguished from at least a part of its vicinity by at least one differently dimensioned or distributed vibration parameter;

the center distances (D1, D2, D3) between subsequent distinguished areas, or the distances between certain sections within subsequent distinguished areas, being dimensioned according to at least one predetermined increasingly or decreasingly varying progression;

said increasingly or decreasingly varying distances being configured such that said areas establish a vibration active structure (G) of said sliding body with a plurality of natural or resonant frequencies.

2. A sliding device, in particular a ski, comprising:

a sliding body, and means on said sliding body for controlling vibration behavior of said sliding body; said means comprising:

at least one sequence of a plurality of spatial, planar or linear areas (A1, A2, A3; B1, B2, B3), each of which is distinguished from at least a part of its vicinity by at least one differently dimensioned or distributed vibration parameter;

the extremal or average values, or the distribution of the values, of at least one vibration parameter in subsequent distinguished domains being dimensioned according to at least one predetermined increasingly or decreasingly varying progression;

said increasingly or decreasingly varying distances being configured such that said areas establish a vibration active structure (G) of said sliding body with a plurality of natural or resonant frequencies.

3. A sliding device according to one of claims 1 or 2, in which the distinguishing vibration parameter of said spatial, planar or linear areas is selected from the group consisting of (i) spatial or planar local mass density, (ii) deformation rigidity, and (iii) vibration damping.

4. A sliding device according to one of claims 1 or 2 including a sequence of distances or values varying oscillatingly at least by sections.

5. A sliding device according to one of claims 1 or 2 wherein said at least one increasingly or decreasingly varying progression is a harmonic progression.

6. A sliding device according to one of claims 1 or 2 wherein said at least one increasingly or decreasingly varying progression is a geometric progression.

7. A sliding device according to one of claims 1 or 2, characterized by at least one vibration-reactive subdivision which comprises at least one superpositional structure extending in a linear, superficial or spatial manner and including at least two sequences of distances and/or partitions and/or values.

8. A sliding device according to claim 7 wherein said superpositional structure comprises at least two equidistant sequences.

9. A sliding device according to claim 8 wherein the values and/or distributions of at least one vibration parameter in the succeeding distinct regions of one of said equidistant sequences are dimensioned at least approximately equal.

10. A sliding device according to claim 7 wherein at least one of said at least two sequences is at least partially a harmonic or geometric progression.

11. A sliding device according to one of claims 1 or 2 wherein at least one sequence has distinct regions with differently dimensioned or distributed vibration parameters and extending in a plurality of spatial or planar directions.

12. A sliding device according to claim 11 characterized in that different dimensions or spatial or superficial directions in which a sequence of distinct regions with differently dimensioned or distributed vibration parameters extends, are coordinated with sequences of at least partially different distances between said distinct regions and/or of different vibration parameter variations from region to region.

13. A sliding device according to one of claims 1 or 2 including at least one vibration-reactive preferably harmonic or geometric subdivision, particularly for a plurality of such vibration-reactive subdivisions in mutual superposition, extending over at least five pitches.

14. A longitudinally extending sliding device according to one of claims 1 or 2 including at least one vibration-reactive subdivision extending in the direction of the width of the sliding device.

15. A longitudinally extending sliding device according to one of claims 1 or 2 including at least one vibration-reactive subdivision extending at an angle, preferably approximately a right angle, to the plane defined by the length and width of the sliding device.

16. A sliding device according to one of claims 1 or 2 wherein the distinct regions of different vibration parameters are distributed along at least one edge of the sliding device.

17. A sliding device according to one of claims 1 or 2 in which a plurality of said vibration parameters comprise areas of reduced mass density or deformation rigidity formed as depressions or perforations within a surface of said sliding body.

18. A sliding body according to one of claims 1 or 2 in which a plurality of said vibration parameters comprise areas of enhanced or reduced local mass density or local deformation rigidity formed by means of elements embedded in said sliding body.

19. A sliding device according to claim 18 in which said embedded elements comprise at least in part a material different from the basic material of said sliding body, in particular a material of enhanced or reduced mass density and/or enhanced or reduced elastic modulus.

20. A sliding device according to one of claims 1 or 2, comprising a surface layer portion forming said vibration parameter.

21. A sliding device, in particular a ski, comprising:

a sliding body, and means on said sliding body for controlling vibration behavior of said sliding body, said means comprising:

at least one sequence of a plurality of spatial, planar or linear areas (A1, A2, A3; B1, B2, B3), each of which is distinguished from at least a part of its vicinity by at least one differently dimensioned or distributed vibration parameter;

the center distances (D1, D2, D3) between subsequent distinguished areas, or the distances between certain sections within subsequent distinguished areas, being dimensioned according to at least one predetermined increasingly or decreasingly varying progression;

the extremal or average values, or the distribution of the values, of at least one vibration parameter in subsequent distinguished domains being dimensioned according to at least one predetermined increasingly or decreasingly varying progression;

said increasingly or decreasingly varying progressions being configured such that said areas establish a vibration active structure (G) of said sliding body with a plurality of natural or resonant frequencies.

22. A sliding device according to claim 21 in which the distinguishing vibration parameter of said spatial, planar or linear areas is selected from the group consisting of (i) spatial or planar local mass density, (ii) deformation rigidity, and (iii) vibration damping.

* * * * *